US010196197B2

(12) United States Patent
Yeo

(10) Patent No.: US 10,196,197 B2
(45) Date of Patent: Feb. 5, 2019

(54) PACKAGING CONTAINER WITH IMPROVED DISCHARGE RATE OF CAPSULE-SHAPED CONTENTS

(71) Applicant: Toly Korea Inc., Bucheon-si, Gyeonggi-do (KR)

(72) Inventor: Soo Bin Yeo, Bucheon-si (KR)

(73) Assignee: TOLY KOREA INC., Gyeonggi-Do (KR)

( * ) Notice: Subject to any disclaimer, the term of this patent is extended or adjusted under 35 U.S.C. 154(b) by 0 days.

(21) Appl. No.: 15/718,420

(22) Filed: Sep. 28, 2017

(65) Prior Publication Data

US 2018/0099807 A1 Apr. 12, 2018

(30) Foreign Application Priority Data

Oct. 7, 2016 (KR) ..... 10-2016-0129456

(51) Int. Cl.
*B65D 83/04* (2006.01)
*B65D 41/04* (2006.01)
(Continued)

(52) U.S. Cl.
CPC ..... *B65D 83/0409* (2013.01); *B65D 41/04* (2013.01); *B65D 43/02* (2013.01); *B65D 47/12* (2013.01); *B65D 51/18* (2013.01); *B65D 83/0011* (2013.01); *B65D 2251/009* (2013.01); *B65D 2251/0018* (2013.01);
(Continued)

(58) Field of Classification Search
USPC ..... 221/194–196, 246, 254, 256, 263, 270, 221/277
See application file for complete search history.

(56) References Cited

U.S. PATENT DOCUMENTS 3,176,535 A 4/1965 Rowland
3,715,055 A 2/1973 Kendrick et al.
(Continued)

FOREIGN PATENT DOCUMENTS

CA 1088859 11/1980
FR 1200571 12/1959
(Continued)

OTHER PUBLICATIONS

International Search Report mailed in corresponding application PCT/KR2016/00790 dated Sep. 23, 2016.

*Primary Examiner* — Gene O Crawford
*Assistant Examiner* — Ayodeji T Ojofeitimi
(74) *Attorney, Agent, or Firm* — Wissing Miller LLP

(57) ABSTRACT

A container for storing capsules and discharging them individually, including an upwardly open capsule-holding receptacle, a cap rotatably mounted on the receptacle, an upright discharge guide rod having one or plural outwardly opening vertical movement passages on its periphery, fixedly mounted in the receptacle, and a hollow cylinder concentrically surrounding the guide rod within the receptacle and coupled to the cap for rotation therewith. A thread on the inner surface of the cylinder faces and cooperates with the vertical movement passages to receive capsules admitted from the receptacle through an entry port in the cylinder and, as the cap is rotated, to raise the admitted capsules one by one to a central discharge port in the cap.

19 Claims, 7 Drawing Sheets

(51) Int. Cl.

| | |
|---|---|
| ***B65D 43/02*** | (2006.01) |
| ***B65D 47/12*** | (2006.01) |
| ***B65D 51/18*** | (2006.01) |
| ***B65D 83/00*** | (2006.01) |

(52) U.S. Cl.
CPC ..... *B65D 2251/0025* (2013.01); *B65D 2251/0028* (2013.01); *B65D 2251/0078* (2013.01); *B65D 2251/0087* (2013.01); *B65D 2583/0477* (2013.01)

(56) References Cited

U.S. PATENT DOCUMENTS

| | | | | |
|---|---|---|---|---|
| 4,560,086 | A | 12/1985 | Stol | |
| 4,965,951 | A | 10/1990 | Miller | |
| 5,213,232 | A | 5/1993 | Kraft et al. | |
| 5,542,570 | A | 8/1996 | Nottingham | |
| 5,592,760 | A | 1/1997 | Kohout | |
| 5,791,515 | A * | 8/1998 | Khan | B65D 83/0409 206/533 |
| 6,860,403 | B1 | 3/2005 | Mehrens et al. | |
| 7,204,391 | B2 | 4/2007 | Toker | |
| 7,314,131 | B2 | 1/2008 | Olds | |
| 8,672,185 | B2 * | 3/2014 | Worthington | B05B 7/2443 206/219 |
| 8,727,180 | B2 | 5/2014 | Zonana et al. | |
| 2003/0189494 | A1 * | 10/2003 | Lin | B65D 41/34 340/686.1 |
| 2006/0086592 | A1 | 4/2006 | Olds | |
| 2006/0255059 | A1 * | 11/2006 | Brown | A47J 36/20 221/270 |
| 2006/0283726 | A1 * | 12/2006 | McCloud | A45D 19/02 206/219 |
| 2008/0099310 | A1 | 5/2008 | Olds | |
| 2012/0145740 | A1 * | 6/2012 | Chu | B65D 83/0409 221/277 |
| 2015/0001245 | A1 | 1/2015 | Kroll et al. | |
| 2015/0151898 | A1 * | 6/2015 | Desset-Brethes | B65D 83/04 221/1 |
| 2015/0266654 | A1 | 9/2015 | Baarman et al. | |
| 2016/0120760 | A1 | 5/2016 | Nazginov | |

FOREIGN PATENT DOCUMENTS

| | | |
|---|---|---|
| JP | 2001-048287 | 2/2001 |
| JP | 3075575 | 2/2001 |
| KR | 10-1998-0709364 | 11/1998 |
| KR | 20-2003-0021454 | 7/2003 |
| KR | 20-2003-0027827 | 8/2003 |
| KR | 20-2008-0003947 | 9/2008 |
| KR | 10-20110076853 | 7/2011 |
| KR | 10-1202811 | 11/2012 |
| KR | 10-1342843 | 12/2013 |
| KR | 20140141277 | 12/2014 |
| WO | 20000064783 | 11/2000 |
| WO | 2011154448 | 12/2011 |

* cited by examiner

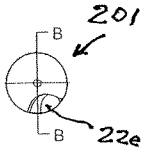
FIG. 7c
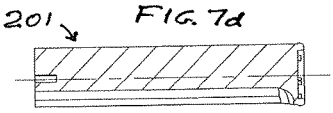
FIG. 7d
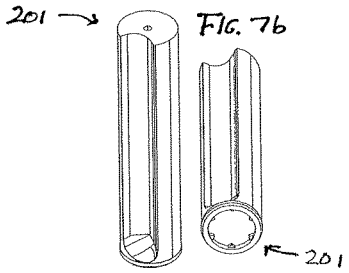
FIG. 7b
FIG. 7a
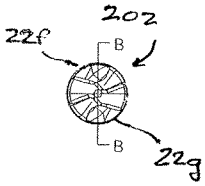
FIG. 8c
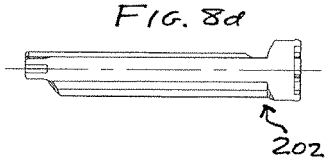
FIG. 8d
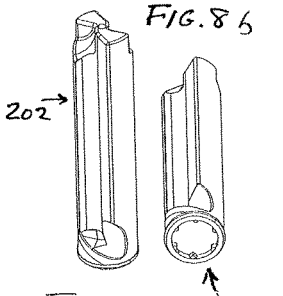
FIG. 8b
FIG. 8a
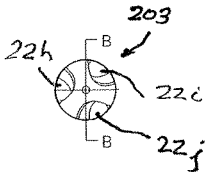
FIG. 9c
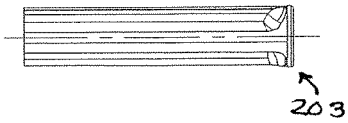
FIG. 9d
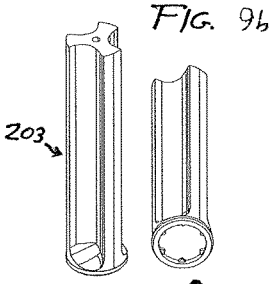
FIG. 9b
FIG. 9a
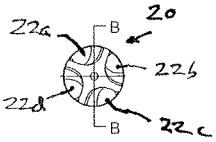
FIG. 10c
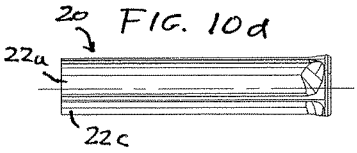
FIG. 10d
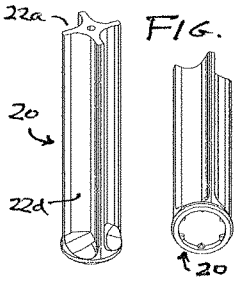
FIG. 10b
FIG. 10a

PACKAGING CONTAINER WITH IMPROVED DISCHARGE RATE OF CAPSULE-SHAPED CONTENTS

CROSS REFERENCE TO RELATED APPLICATION

This application claims the right to priority, under 35 U.S.C. § 119(a), of Republic of Korea patent application No. KR 10-2016-0129456 filed Oct. 7, 2016 (now Republic of Korea patent No. 10-1759061), the disclosure of which is incorporated herein in its entirety by this reference.

BACKGROUND OF THE INVENTION

This invention relates to containers for storing capsules, and more particularly to such containers providing discharge of capsules individually, i.e., one by one.

A variety of products, including cosmetics, drugs, foods, detergents and the like, are commonly prepared in the form of capsules, which are packaged in bottles or other containers for storage and sale. In general, a capsule container includes a body constituting a receptacle for holding a plurality of capsules, and a lid for closing the receptacle. To obtain one or more capsules from the container, a user may take off the lid and tilt the open receptacle to cause capsules to fall out, or reach into the receptacle to remove capsules with the fingers.

Such operations present problems, however, in that when the open receptacle is tilted, an undesired excess of capsules may come out, while manual extraction of capsules from within the receptacle is not easily accomplished. In either case, there is a danger that capsules not intended to be withdrawn may be contaminated by contact with surfaces outside the container or with the user's fingers inside the container. Additionally, if the capsules are of low strength (as are some cosmetic capsules), attempted extraction with the fingers may subject them to breakage.

Expedients for overcoming these difficulties have heretofore been proposed, for example in Republic of Korea registered utility model No. 20-0334691 and Republic of Korea patent No. 10-1342843. The proposed expedients, however, do not entirely prevent discharge of more than one capsule at a time, may exert pressure sufficient to cause breakage of low-strength cosmetic capsules, and may require inconveniently complex manipulation.

Copending U.S. patent application Ser. No. 15/178,618 filed Dec. 14, 2016 (hereinafter App. '618), having the same inventor as the present application, and incorporated herein in its entirety by this reference, discloses a capsule container for storing plural capsules and discharging the stored capsules individually, comprising an upwardly open container body including a receptacle portion for holding a plurality of capsules; a cap mounted on the container body for manual rotation relative thereto about a vertical axis and having a discharge port; an upright screw shaft disposed within and fixedly secured to the receptacle portion and having a circumferential spiral groove; and a hollow cylinder coupled to the cap for rotation therewith, extending downwardly from the cap through the receptacle portion in surrounding concentric relation to the screw shaft, the cylinder having an inner surface bearing a screw thread facing the spiral groove, a lower part of the cylinder having an entry port for admitting stored capsules from the receptacle portion individually into the cylinder, and the cylinder communicating upwardly with the discharge port, wherein the thread and the groove are coaxial and are mutually dimensioned and configured to receive between them an individual capsule admitted into the cylinder through the entry port and, upon rotation of the cap in a particular direction relative to the container body, to cause admitted capsules to be raised one by one from the entry port to the discharge port.

However, in this container, since the capsules are moved upward one by one along the movement path defined by the screw thread of the rotary cylinder and the spiral groove of the screw shaft, the discharge speed of the capsule-shaped contents is lowered, and there is an inconvenience that the rotation cap must be rotated several times in order to initially discharge the capsules.

In addition, when the receptacle portion contains multiple capsules, the weight of capsules pressing down on those capsules at the level of the entry port of the rotary cylinder may cause more than one capsule to enter the cylinder at the same time, resulting in poor discharge.

SUMMARY OF THE INVENTION

An object of the invention is to provide a packaging container for capsules affording the advantages of the container described in App '618, and having an improved discharge speed of capsules.

To this and other ends, the invention broadly contemplates the provision of a capsule container for storing plural capsules and discharging the stored capsules individually, comprising an upwardly open container body including a receptacle portion or vessel for holding a plurality of capsules; a cap mounted on the container body for manual rotation relative thereto about a vertical axis and having a discharge port; an upright discharge guide rod disposed within and fixedly secured to the receptacle portion and having at least one outwardly open vertical movement passage on its periphery; and a hollow cylinder coupled to the cap for rotation therewith, extending downwardly from the cap through the receptacle portion in surrounding concentric relation to the guide rod, the cylinder having an inner surface bearing a screw thread facing the at least one vertical movement passage, a lower part of the cylinder having an entry port for admitting stored capsules from the receptacle portion individually into the cylinder, and the cylinder communicating upwardly with the discharge port, wherein the screw thread and the at least one vertical movement passage are mutually arranged to receive individual capsules admitted into the cylinder through the entry port, and, upon rotation of the cap in a particular direction relative to the container body, to cause admitted capsules to be raised one by one from the entry port to the discharge port.

The container body may include a main body portion joined to a lower part of the receptacle portion.

Very advantageously, the guide rod may have a plurality of outwardly open vertical movement passages on its periphery, the screw thread facing all of the vertical movement passages, and the screw thread and each of the vertical movement passages being mutually arranged to receive individual capsules admitted into the cylinder through the entry port, and, upon rotation of the cap in a particular direction relative to the container body, to cause admitted capsules to be raised one by one from the entry port to the discharge port.

The guide rod may have an upper end exposed above the hollow cylinder. In addition, the hollow cylinder advantageously includes a capsule inflow guide protruding outwardly from the cylinder on one side of the entry port; and the container may have a container lid mounted over the cap. Multiple first interlocking protrusions may be formed on the cap and multiple second interlocking protrusions may be formed on the cylinder for coupling with the first interlocking protrusions so that the cylinder rotates with the cap. The container may also include a first ratchet gear provided on the container body and a second ratchet gear provided on the cap, wherein the first and second gears interlock to restrict rotation of the cap about the vertical axis to the aforesaid particular direction.

The container may have a discharge cover provided with the discharge outlet (port) centrally disposed on the cap on the capsule-holding vessel (receptacle), so that when the cap and cylinder are rotated and capsules move from the receptacle through the entry port into the rotating cylinder, the capsules are raised upwardly by a vertical movement passage of the guide rod and the thread of the cylinder and are easily discharged one by one to the upper surface of the cap through the discharge port of the discharge cover. The entry port of the cylinder may be provided with an upper cover protruding outwardly from the top of the entry port. In addition, an anti-friction part may be formed on the bottom of the receptacle. Each capsule is easily introduced into the rotating cylinder through the entry port as it naturally moves when the cap rotates, and is raised along a vertical movement passage by the spiral of the cylinder thread, advancing smoothly upward to the discharge cover and discharge port on the cap.

Moreover, a first sealing ring may be formed on the inside of the vessel so as to be in close contact with the inner periphery of the vessel. The container may also have a vessel lid removably mounted in a closed position on the vessel, the lid having a second sealing ring of elastic material formed on the inside of the vessel lid so as to be in close contact with a top surface of the cap when the vessel lid is in the closed position. Furthermore, a sealing driver may be formed in close contact with the second sealing ring of the vessel lid on the top surface of the rotary cap. A slope may be formed on the lower side of the discharge port so that capsules can be naturally discharged from the discharge port.

In currently preferred embodiments of the invention, the vertical movement passages are distributed substantially equidistantly around the outer periphery of the guide rod. Each of the vertical movement passages of the discharge guide rod has an inner surface formed in a curved shape. Preferably the number of vertical movement passages on the periphery of the discharge guide rod is between one and eight. An inflow slope part is formed at the bottom of each of the vertical movement passages.

In operation of the container, when the rotary cap is rotated one turn, capsules accommodated in the vessel are introduced into the vertical movement passages formed on the outer periphery of the discharge guide rod, and are sequentially moved and discharged upward in their respective passages by following the screw thread of the rotary cylinder. Therefore, the capsules are easily discharged one by one at a high speed even if the rotary cylinder is not rotated several times, so that, in the present invention, by forming a plurality of x (e.g., four) vertical movement passages at the outer periphery of the discharge guide rod, when the rotary cap is rotated one turn, a capsule is discharged every time the rotary cap is rotated 1/x turn, so as to provide a packaging container with improved discharge speed that is easy to use. Further, the discharge speed at which the capsules easily flow into the respective vertical movement passages through the inlet of the rotary cylinder is improved, by forming the inflow slope part on the bottom side of the plurality of vertical movement passages formed at the outer periphery of the discharge guide rod.

Terms such as "upwardly," "downwardly," "upper," "lower," "vertically," "horizontally," "top," "bottom" and the like, as used herein, will be understood to refer to positions, directions and orientations subsisting when the container is standing upright on a table.

Further features and advantages of the invention will be apparent from the detailed description set forth below, together with the accompanying drawings.

BRIEF DESCRIPTION OF THE DRAWINGS

FIGS. 7*a*, 7*b*, 7*c* and 7*d* are, respectively, perspective views from above and below, a top view and a sectional elevational view of a discharge guide rod, for a container of the invention, having a single vertical movement passage;

FIGS. 8*a*, 8*b*, 8*c* and 8*d* are, respectively, perspective views from above and below, a top view and a sectional elevational view of a discharge guide rod, for a container of the invention, having two vertical movement passages;

FIGS. 9*a*, 9*b*, 9*c* and 9*d* are, respectively, perspective views from above and below, a top view and a sectional elevational view of a discharge guide rod, for a container of the invention, having three vertical movement passages; and FIGS. 10*a*, 10*b*, 10*c* and 10*d* are, respectively, perspective views from above and below, a top view and a sectional elevational view of a discharge guide rod, for the embodiment of the invention illustrated in FIGS. 1-6, having four vertical movement passages.

DETAILED DESCRIPTION

The illustrative embodiment of the capsule container of the present invention shown in FIGS. 1-6 includes a capsule container receptacle or vessel for holding a plurality of capsules wherein a vertical discharge guide rod having a plurality (here, four) of outwardly open vertical movement passages or grooves formed on its outer circumference is affixed to and formed on the center of the interior of the container receptacle and a rotary cap is rotatably coupled to the top of the container receptacle, a rotary hollow cylinder is coupled to the lower center of the rotary cap for rotation therewith about the guide rod and disposed on the outside of the guide rod in surrounding concentric relation thereto, a discharge cover provided with a discharge outlet is formed on the top center of the rotary cap, a spiral thread is formed on the inner periphery of the rotary cylinder, and an inlet or entry port is formed on one lower side of the cylinder. Thus, when the rotary cap is rotated, successive capsules held in the receptacle enter the rotating cylinder through the entry port, flow into the respective vertical movement passages, and are then moved along the passages to the top of the container by the screw thread of the cylinder and easily discharged one by one to the upper surface of the rotary cap through the discharge port of the discharge cover.

Further, an anti-friction part is formed on the bottom of the receptacle, an inflow guide is formed so as to project to one side of the entry port of the rotary cylinder, and the vertical movement passages and the thread of the cylinder are so formed that when the cap is rotated, after capsules are easily introduced through the entry port into the rotary cylinder as it naturally moves, each capsule is received in one of the vertical movement passages and, within that movement passage, engages and is smoothly moved upwardly along the groove by the spiral thread of the rotary cylinder to the top of the container. A slope is formed on the lower part of the discharge cover so that the capsule may be naturally discharged. The inflow guide formed on one side of the entry port of the rotary cylinder is constituted of an upper cover formed so as to protrude on the top of the entry port, and a side cover formed so as to protrude on one side of the entry port.

In addition, the container has a lid. A first sealing ring is formed on the inside of the container vessel or receptacle so as to come into close contact with the inner periphery of the receptacle, and a second sealing ring of an elastic material is formed on the inside of the vessel lid such that when the lid is closed, the second sealing ring comes in close contact with the top surface of the rotary cap; therefore, during transport or storage of the container, the sealing force of the inside of the container is improved.

Figure 1:
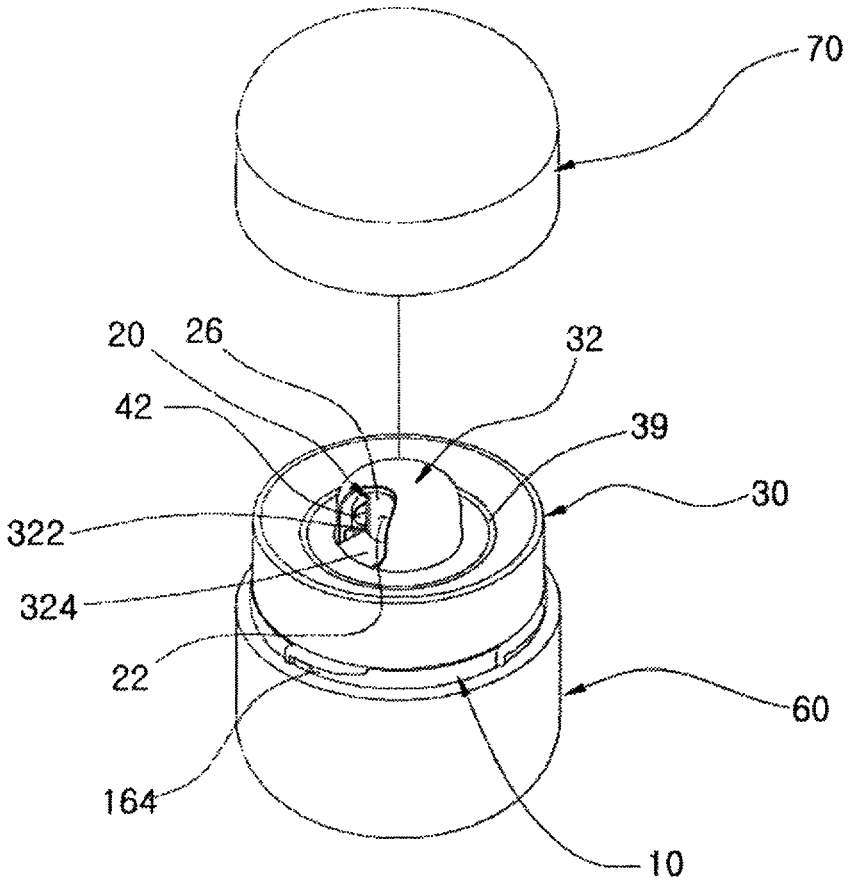
FIG. 1 is a perspective view of a capsule container embodying the present invention in a particular form.
Figure 2:
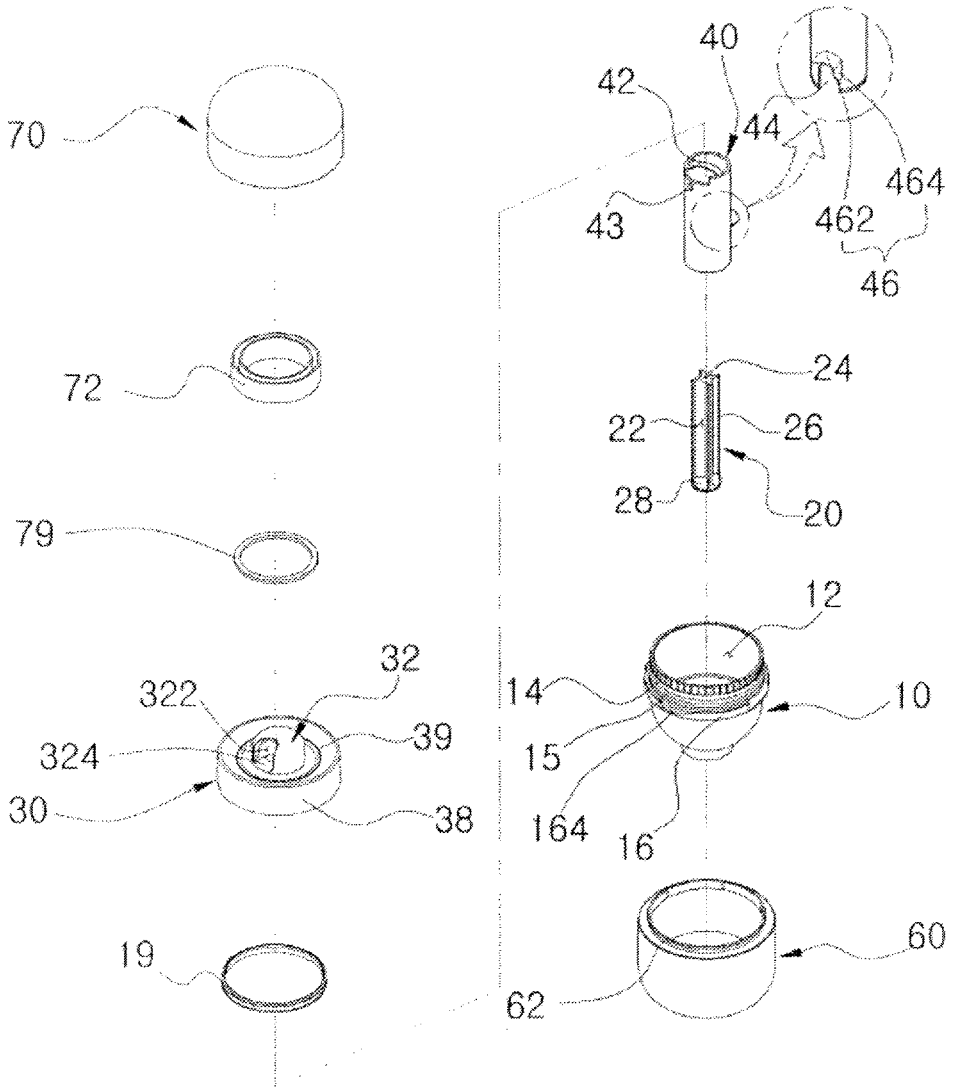
FIG. 2 is an exploded perspective view of the capsule container of FIG. 1.
Figure 3:
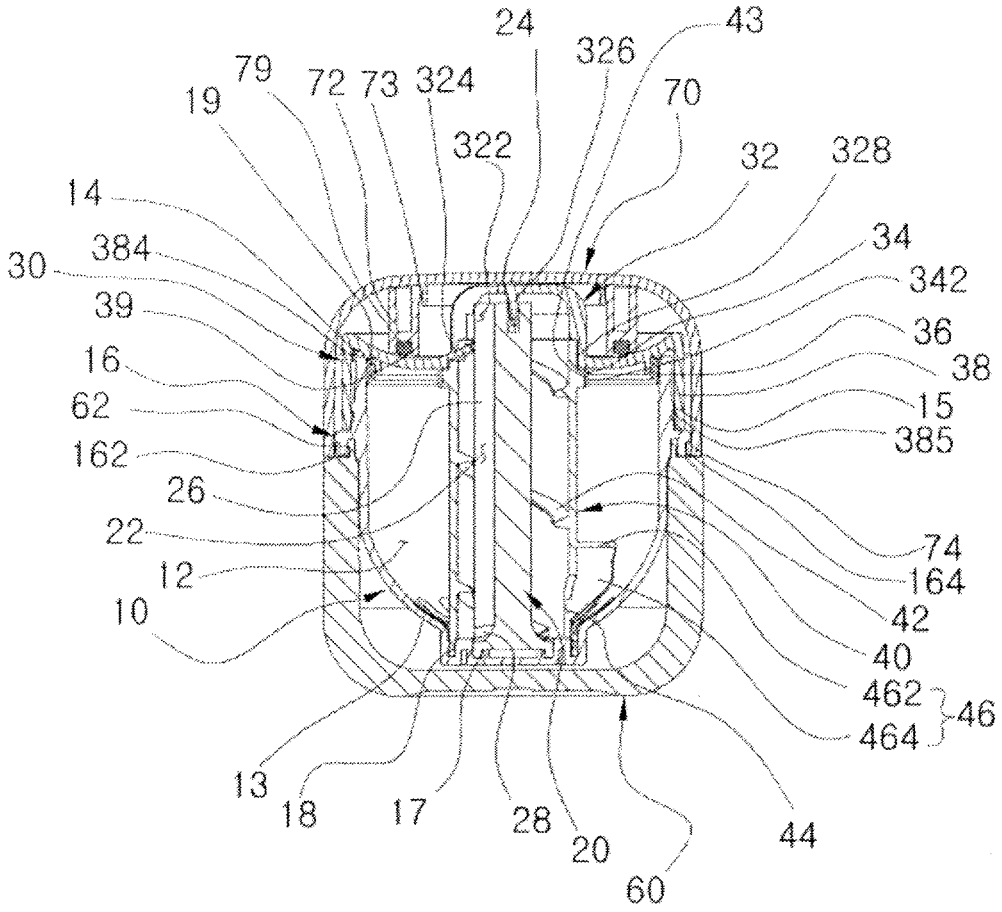
FIG. 3 is a sectional elevational view of the capsule container of FIG. 1.

Referring particularly to FIGS. 1-3, which are respectively a perspective view, an exploded perspective view and a sectional elevational view of this embodiment, the container shown includes a vessel or receptacle 10 inside which a plurality of capsules 50 are stored; a discharge guide rod 20 fixedly coupled to the center of the receptacle 10 inside the receptacle; a rotary cap 30, rotatably coupled to the receptacle 10 for rotation relative thereto about the vertical axis of the guide rod; and a rotary cylinder 40, fixedly coupled to the lower side of cap 30 and disposed on the outside of (concentrically surrounding) the guide rod 20, the cylinder being provided with an inlet or entry port 44. Four straight, outwardly open vertical movement passages 22*a*, 22*b*, 22*c* and 22*d* along which capsules 50 are moved are formed on (and positioned equidistantly around) the outer periphery of the discharge guide rod 20, and a screw spiral thread 42 is formed on the inner surface of the cylinder 40 for pushing capsules 50 upward in the movement passages 22*a*-22*d*. A discharge cover 32 provided with a discharge port 322 is formed in the center of the cap 30.

This interior of the container vessel or receptacle 10 is a capsule-receiving space 12, in which a plurality of capsules 50 (shown as spherical) are stored. The contents of the capsules 50 stored in container receptacle 10 may be cosmetics, tablets, pill medications, gum or the like, for example cosmetic capsules; the term "cosmetic capsules" herein refers to capsules formed of bead-shaped thin film wherein a gel- or liquid-form cosmetic material is filled within the capsules, and the contents filling the inside of the capsules are discharged by breaking the thin film for use.

A first ratchet gear 14 of saw-toothed shape rotated in only one direction is formed on the upper, outer periphery of the receptacle 10 so that the cap 30 can be rotated only in one direction relative to the receptacle. A first fastening extension 15 is formed on the outer periphery of the receptacle 10 to which cap 30 is undercut-coupled.

A lower extension ring 16 is extended to the lower side of the first fastening extension 15, a first installing extension or mounting ring 162 is formed so as to extend inward to the inner periphery of the lower extending extension ring 16, and an opening/closing groove 164 is formed on one side of the outer periphery.

The inner bottom surface of the receptacle 10 is of a concave shape. A discharge guide rod coupling groove 17, to which the guide rod 20 is fixedly coupled, is formed on the center of the receptacle bottom surface, and a mounting or installation groove 18, to which the rotary cylinder 40 is rotatably coupled, is formed outside of and in concentric relation to the coupling groove 17.

An anti-friction part 13 may be formed on the bottom of the receptacle 10. This anti-friction part is formed in the shape of a radial-shaped groove on the bottom of receptacle 10. For the anti-friction part 13 to reduce the area where the bottom inner surface of the receptacle 10 and capsules 50 are in contact so that capsules flow easily, when the capsules are caused to move horizontally while the inflow guide 46 of cylinder 40 is rotated, friction is generated by surface contact of capsules with the bottom surface of the receptacle, preventing crushing by pressing on the inflow guide 46.

A first sealing ring 19 for sealing the inside of the container receptacle 10 is formed on the inside of, and in close contact with the inner periphery of, receptacle 10. When the container is transported or stored, the moisture content of the capsules 50 accommodated within the receptacle is maintained by the first sealing ring 19, and drying of the capsules is prevented.

A container body 60 surrounding the receptacle 10 is coupled on the outside of the receptacle. A second installing extension ring 62 is formed on the upper outer periphery of the body 60 and undercut coupled with the first installing extension ring 162 of the receptacle 10.

The discharge guide rod 20, as stated, is fixedly coupled to the center of the inside of container receptacle 10, the lower end of the guide rod being force fit-coupled or screw-coupled to the coupling groove 17 of the receptacle. Alternatively, the guide rod 20 may be integrally formed on the center of the bottom surface of receptacle 10. The guide rod, having the aforesaid plurality of vertical movement passages or grooves 22*a*-22*d* formed on its outer periphery, extends vertically upward; the top of the guide rod is positioned inside the discharge cover 32 of the rotary cap 30.

A fixing groove 24 is formed on the upper end of the guide rod 20, and a fixing protrusion 326 of the rotary cap 30 is inserted therein. The rotary cap 30, rotatably coupled to the top of receptacle 10, bears the discharge cover 32 at its center; cover 32 is provided with discharge port 322 formed on one side thereof. The discharge cover may either be formed integrally with the cap 30 or it may be separately formed.

A plurality of blades 26 are formed to protrude outwardly to the outer periphery of the discharge guide rod 20, and a vertical movement passage 22 is formed between each two adjacent blades 26.

While four vertical movement passages 22*a*-22*d* are present in the embodiment of FIGS. 1-6, the number of vertical movement passages on a vertical guide rod 20 in the packaging container of the invention may generally be between one and eight, very preferably between two and eight. When the number of vertical transfer passages exceeds eight, too many vertical movement passages are present on the outer periphery of the discharge guide rod 20, and the width of the individual vertical movement passages becomes smaller than the diameter of the capsules 50, presenting the problem that the capsules cannot enter the vertical movement passages.

The inside surface of each of the vertical movement passages 22*a*-22*d* of the discharge guide rod 20 is formed in a curved shape such that when capsules 50 are raised in a vertical movement passage, they rise in contact with the inside surface of the vertical movement passage, the curved inner surface of which enables them to be easily moved along the length of the passage without being distorted.

An inflow slope part 28 is formed in the bottom of each of the vertical movement passages 22*a*-22*d*; this inflow slope part 28 ensures that the capsules 50 caused to flow in through the inlet or entry port 44 of the rotary cylinder 40 can be smoothly moved to a vertical movement passage of the guide rod.

A sloped surface 324 may be formed below the discharge port 322 of the discharge cover 32 so that the capsule-shaped contents 50 are discharged naturally. That is to say, a capsule 50 moved upward by one of the vertical movement passages 22*a*-22*d* of the discharge guide rod 20 and the screw thread 42 of the rotary cylinder 40 follows slope 324 from the upper end of the vertical movement passage, naturally tumbles down the inclined surface 324 and is discharged to the upper surface of the rotary cap 30.

The fixing protrusion 326, formed on the inner side of the discharge cover 32 and inserted into the fixing groove 24 of the discharge guide rod 20, keeps the guide rod centered so that the guide rod does not tilt in any direction.

An insertion groove 328, into which the rotary cylinder 40 is inserted, is formed on the lower inner periphery of the discharge cover 32. The top surface of the rotary cap 30 is of a concave curved shape; a closed protrusion 39, in close contact with a second sealing ring 79 of the container lid 70 may be formed on one side of the cap top surface.

A first lower extending extension ring 34 is formed on the bottom of the rotary cap 30 so as to extend downward, a second lower extending extension ring 36 is spaced at regular intervals outwardly from the first lower extending extension ring 34, and a third lower extending extension ring 38 is formed so as to be spaced at regular intervals outwardly from the second lower extending extension ring 36. A fitting groove 342 is formed on the inner periphery of the first lower extending extension ring 34 by coupling with the rotary cylinder 40. A first sealing ring 19 is inserted between the second lower extending extension ring 36 and container receptacle 10, and seals the inside of receptacle 10.

A second fastening extension ring 385 is formed so as to protrude to the inner periphery of the third lower extending extension ring 38 and undercut couples with the first fastening extension ring 15 of the receptacle 10.

A second ratchet gear 384 engaging with the first ratchet gear 14 of the receptacle 10 is formed on the top outer periphery of the third lower extending extension ring 38. Therefore, the rotary cap 30 can rotate only in one direction relative to the receptacle 10, and reverse rotation is prevented. Also, when the rotary cap 30 is rotated, the second ratchet gear 384 of cap 30 follows the first ratchet gear of receptacle 10 and a sound is made when the second gear goes beyond the first gear, so that the user may know that a capsule is rising.

The rotary cylinder 40 is installed on the outside of (concentrically surrounding) the discharge guide rod 20; at the same time, the cylinder is coupled to the central lower side of the rotary cap 30, the top of cylinder 40 being inserted into the insertion groove 328 of the cap and the bottom of the cylinder being rotatably coupled with the mounting groove 18 of receptacle 10.

Fitting protrusion 43 is formed on the outer periphery of the top of the rotary cylinder 40 and coupled with fitting groove 342 of the cap 30. When the fitting protrusion 43 fits into fitting groove 342 and the cap rotates, the cylinder 40 does not run in a disengaged manner; this serves to ensure that rotation of the cylinder occurs together with rotation of the cap 30.

The inlet or entry port 44 is formed on the lower side of the cylinder 40 so that capsules 50 are introduced one by one into the cylinder, and the inflow guide 46 is formed so as to protrude outwardly at one side of port 44. This inflow guide includes a top cover 462 protruding at the top of entry port 44 and a side cover 464 protruding at one side of entry port 44.

Figure 5A:
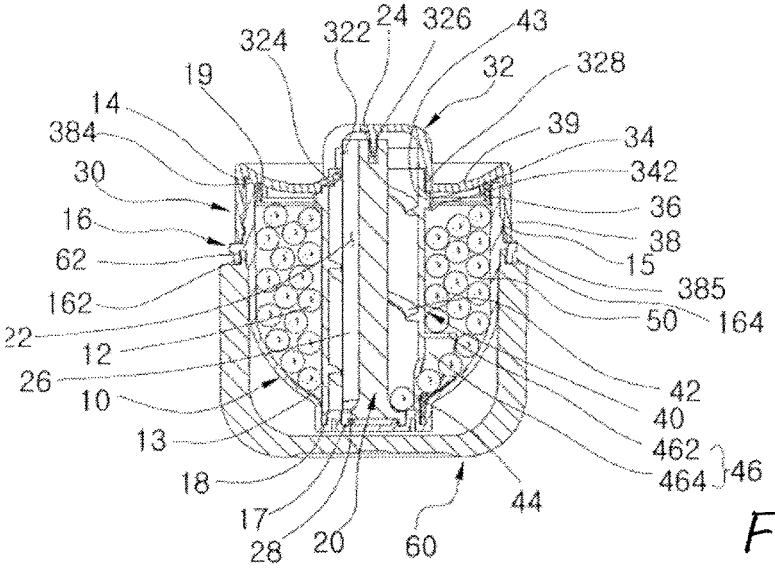
FIG. 5*a* is a sectional elevational view of the capsule container of FIG. 1, illustrating the situation when capsules are being caused to flow into the inside of the hollow cylinder via the entry port as a result of rotation of the hollow cylinder.
Figure 5B:
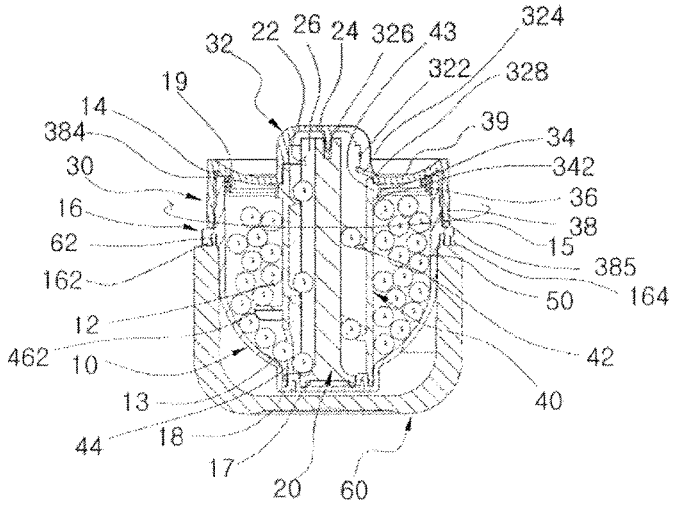
FIG. 5*b* is a view similar to FIG. 5*a* illustrating the situation when the hollow cylinder rotates with the rotary cap and capsules move to the top of the container.
Figure 5C:
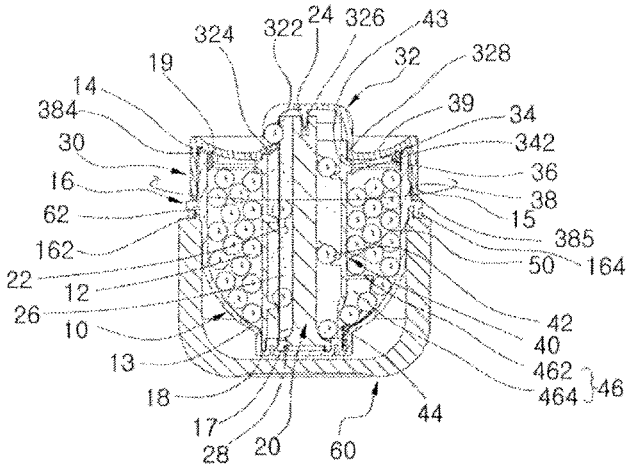
FIG. 5*c* is another view similar to FIG. 5*a* showing the situation when the hollow cylinder rotates with the rotary cap and capsules are discharged individually through the discharge port of the container.

FIGS. 5*a*, 5*b* and 5*c* are sectional elevational views, similar to each other, illustrating the container of FIG. 1 while the cylinder 40 and cap 30 are rotating together relative to the receptacle 10 and discharge guide rod 20. FIG. 5*a* shows the situation in which capsules 50 flow into the cylinder from the receptacle through entry port 44; FIG. 5*b* shows the situation in which capsules are moving upwardly to the top of the receptacle; and FIG. 5*c* shows the situation in which capsules are discharged individually (one by one) through the discharge port 322 onto the concave top surface of the cap.

Features illustrated in FIGS. 5*a*-5*c* address the problem that, as the multiple capsules 50 accommodated within the receptacle 10 are pressed by gravity, two or more of the capsules may enter the cylinder 40 through entry port 44 together. As FIGS. 5*a*-5*c* show, with the inflow guide top cover 462 formed so as to protrude outwardly at the top of the entry port 44, capsules 50 positioned at the front of the entry port are not pressed by other capsules, and enter the entry port one at a time.

Figure 4A:
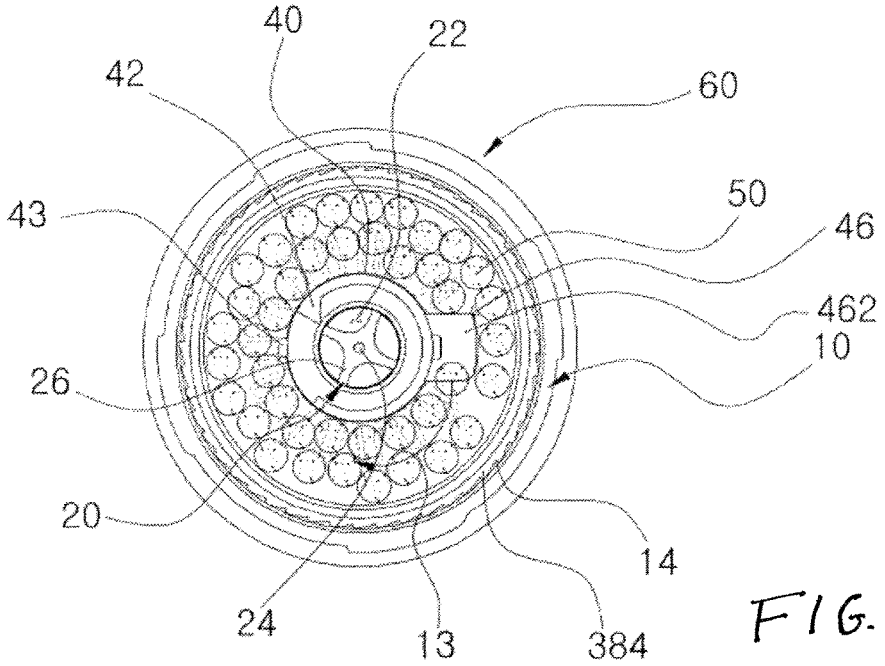
FIG. 4*a* is a plan view of the capsule container of FIG. 1, omitting the cap, illustrating the situation during rotation of the hollow cylinder of the container.
Figure 4B:
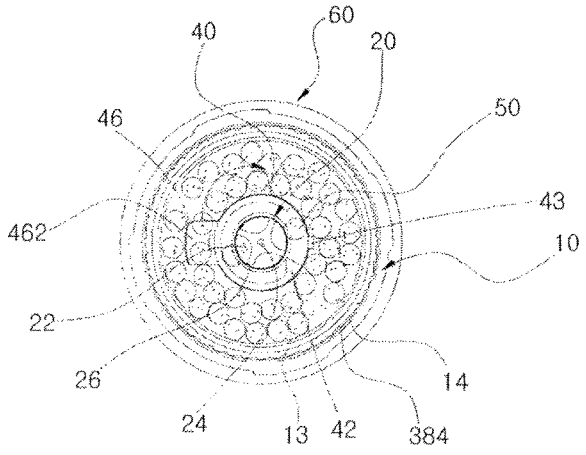
FIG. 4*b* is a view similar to FIG. 4*a* illustrating the situation when capsules are caused to flow into the inside of the hollow cylinder via the entry port as a result of rotation of the hollow cylinder.

FIGS. 4*a* and 4*b* are sectional plan views, similar to each other, illustrating the container of FIG. 1 while the cylinder 40 is rotating relative to the receptacle 10 and discharge guide rod 20. In particular, FIG. 4*b* shows the situation in which capsules 50 flow individually (one by one) into the cylinder through the entry port 44. As will be apparent from these Figures, as the cylinder 40 rotates, the inflow guide 46 rotates together with it, horizontally pushing capsules 50 accommodated within the receptacle 10. Therefore, a capsule 50 is easily pushed and enters the entry port 44 of the rotary cylinder.

A screw thread 42 is formed on the inner periphery of the rotary cylinder 40; the screw thread 42 vertically moves the capsules 50 flowing through the entry port 44 of the rotary cylinder 40 in the vertical movement passages 22*a*-22*d* of the discharge guide rod 20.

That is, when the rotary cap 30 is rotated, the discharge guide rod 20 being fixed to the receptacle 10, as shown in FIG. 5*a*, the rotary cylinder 40 is rotated together with the rotary cap 30, and capsules 50 are successively introduced into the respective vertical movement passages 22*a*-22*d* through the inlet 44; then, as shown in FIG. 5*b*, the screw thread 42 formed on the inner periphery of the rotary cylinder 40 is rotated while the capsules 50 are sequentially pushed upward in each of the vertical movement passages 22. Thereafter, as shown in FIG. 5*c*, when the rotary cap 30 is continuously rotated, each capsule 50 passes through one of the vertical movement passages 22*a*-22*d* of the discharge guide rod 20 and is discharged through the discharge port 322.

In other words, when cap 30 is rotated one turn, cylinder 40 is also rotated together therewith, so that capsules 50 accommodated in the receptacle 10 successively flow into the vertical movement passages 22*a*-22*d* and are engaged and lifted by the screw thread 42 of the rotary cylinder 40 so as to move sequentially upward in their respective vertical movement passages. Accordingly, even if the user does not rotate the rotary cap 30 several times, capsules 50 are discharged one by one at a high speed.

In contrast, in a capsule container as described in App '618, the capsules are rotated along the screw thread of the rotary cylinder and the spiral groove of the screw shaft, while the discharge speed of the capsules is lowered by the upward, one-by-one movement.

In addition, with the capsule container of App. '618, since the capsules are discharged along the spiral groove formed on the screw shaft at the center, the capsules must move over the entire length of the spiral groove; however, with the capsule container of the present invention, the capsules are discharged along a vertical movement passage formed in the discharge guide rod at the center, so that the capsules are moved only over the length of the vertical movement passage and are discharged, thereby shortening the discharge moving distance.

That is, with the capsule container of App. '618, there is an inconvenience that the rotation cap must be rotated several times in order to initially discharge the capsule type contents.

In the embodiment of the present invention shown in FIGS. 1-6, by forming four vertical movement passages 22*a*-22*d* at the outer periphery of the discharge guide rod 20, when the rotary cap 30 is rotated one turn, each time the rotary cap 30 is rotated ¼ turn a capsule 50 is discharged, thereby improving the convenience of use.

A container lid 70 for opening and closing the discharge port 322 of the rotary cap 30 is coupled to the top of the cap 30. A ring-shaped sealing member 72 is coupled to the inside of the container lid 70; this sealing member is undercut-coupled or screw-coupled to the outer periphery of a coupling part 73 formed so as to protrude to the lower side of lid 70. A second sealing ring 79 made of an elastic material is formed on the lower side of the sealing member 72; the second sealing ring 79 is in close elastic contact with the sealing extension 39 of cap 30, as shown in FIG. 3, when the lid 70 is closed. The second sealing ring 79 is formed of elastic material; preferably it consists of one or more materials selected from among natural rubber, elastomer, silicone rubber and acrylonitrile-butadiene rubber (NBR), or of polypropylene (PP) or polyethylene (PE) material.

An opening/closing protrusion 74 is formed on the lower inner periphery of the lid 70 to couple with opening/closing groove 164 of the receptacle 10.

To assemble the capsule container of FIGS. 1-6, as shown in FIGS. 2 and 3, the discharge guide rod 20 is first fixedly coupled to the center of the inside of the receptacle 10, with the lower end of guide rod 20 is coupled to the discharge guide rod coupling groove 17 of receptacle 10. Next, receptacle 10 is inserted into the container body 60 from above, and fixed and coupled thereto.

Subsequently, the lower end of rotary cylinder 40 is coupled to the installation groove 18 of the receptacle 10, so that the discharge guide rod 20 is disposed inside the rotary cylinder.

After that, the inside of the receptacle 10 is filled with capsules 50, and the first sealing ring 19 is inserted into the inner periphery of the top of receptacle 10. Following this, the rotary cap 30 is rotatably coupled to the top of the receptacle 10, the fitting protrusion 43 of cylinder 40 is inserted into the fitting groove 342 of the rotary cap 30, and the first ratchet gear 14 of the receptacle 10 and the second ratchet gear 384 of the rotary cap 30 engage while the first fastening extension 15 of the receptacle 10 and the second fastening extension 385 of the rotary cap 30 are undercut-coupled.

At the same time, the outer periphery of the second lower extension ring 36 of the rotary cap 30 is made to be in close contact with the first sealing ring 19 so that the fixing protrusion 326 of the rotary cap 30 is inserted into the fixing groove 24 of the discharge guide rod 20. Next, sealing member 72 is coupled to coupling part 73 of lid 70, and second sealing ring 79 is fitted into the lower side of the sealing member 72. Finally, lid 70 is coupled to the top of receptacle 10, and opening/closing protrusion 74 of lid 70 is horizontally inserted into opening/closing groove 164 of receptacle 10, to complete the assembly of the container.

In use of the container of FIGS. 1-6, the lid 70 is first separated from the receptacle 10. The user then grasps the container body 60 with one hand while holding cap 30 with the other hand and rotating cap 30 manually, relative to body 60 and receptacle 10, in the one direction permitted by the ratchet gears 14, 384.

When cap 30 rotates, as shown in FIG. 4*a*, the rotary cylinder 40 rotates therewith, and the inflow guide side cover 464 on cylinder 40 horizontally pushes a capsule 50 accommodated within the receptacle 10 so that as shown in FIG. 4*b*, the capsule 50 enters the inside of cylinder 40 through the entry port (inlet) 44 of the cylinder. The inflow guide upper cover 462, protruding outwardly at the top of entry port 44, prevents a capsule 50 positioned in front of the entry port 44 from being pressed by other capsules within the receptacle, so that capsules pass through the entry port one at a time.

In addition, the friction preventing part 13 formed on the bottom of receptacle 10 reduces the area of contact between the bottom surface of receptacle 10 and a capsule, so that the capsules 50 flow easily in the receptacle 10.

Thereafter, as shown in FIGS. 5*a* and 5*b*, while the cap 30 is continuously rotated, with the discharge guide rod 20 fixed to the receptacle 10 and cylinder 40 rotating together with cap 30 relative to the guide rod and the receptacle, each capsule 50 introduced to the cylinder through the entry port 44 is received in one of the vertical movement passages 22*a*-22*d* and pushed upwardly therein to the top of the container.

That is, as shown in FIG. 5A, the capsules 50 are introduced into one or another of the respective vertical movement passages 22*a*-22*d* through entry port 44 of the rotary cylinder 40; then, as shown in FIG. 5*b*, the screw thread 42 formed on the inner periphery of cylinder 40 is rotated while the capsules 50 thus introduced into the respective vertical movement passages 22*a*-22*d* are sequentially pushed up. Thereafter, as shown in FIG. 5*c*, as the rotary cap 30 is continuously rotated, the capsules 50 pass through the vertical movement passages 22*a*-22*d* of the discharge guide rod 20 and are discharged to the discharge port 322.

Figure 6:
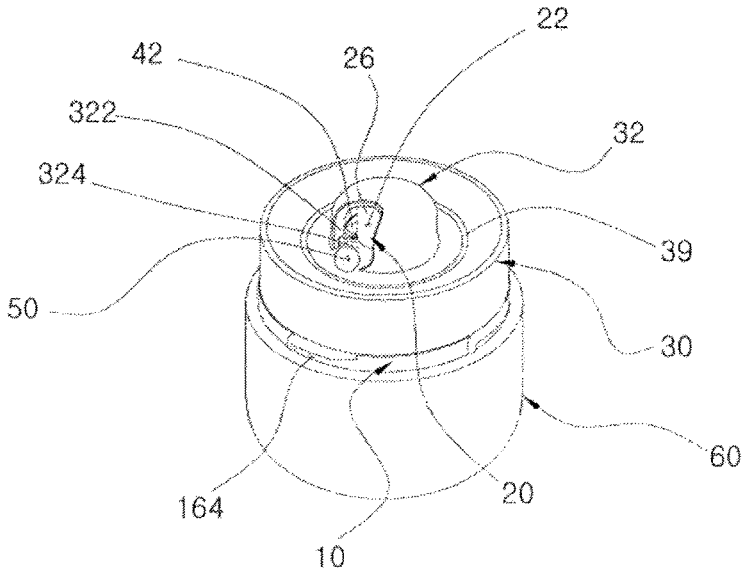
FIG. 6 is a perspective view of the capsule container of FIG. 1, showing the situation in which a capsule is discharged individually to the top surface of the rotary cap of the container.

At this time, since inclined surface 324 is formed on the lower side of the discharge port 322, the capsules 50 naturally roll down from the upper side of the vertical movement passages 22*a*-22*d* along the inclined surface 324, and are discharged one by one to the upper surface of the rotary cap 30 as shown in FIG. 6.

After a desired number of capsules has been discharged, the container is closed by lid 70, and stored or carried. When the lid 70 is coupled to the receptacle 10 as described above, the second sealing ring 79 provided on the inner side of the lid is elastically in close contact with the sealing extension 39 formed on the top surface of the cap 30, and the first sealing ring 19 is in close contact with the inner periphery of the top of receptacle 10 and the outer periphery of the second lower extending extension 36 of cap 30, and the inside of receptacle 10 is sealed.

Although the embodiment of the invention shown in FIGS. 1-6 has a discharge guide rod 20 formed with four equidistantly spaced vertical movement passages 22*a*-22*d*, the discharge guide rod in the container of the invention may have more or fewer vertical movement passages, preferably between 1 and 8, and more preferably between 2 and 8. Several examples of such discharge guide rods are shown in FIGS. 7*a*-7*d*, 8*a*-8*d* and 9*a*-9*d*; similar views of guide rod 20 of FIGS. 1-6 are illustrated in FIGS. 10*a*-10*d*. The discharge guide rod 201 of FIGS. 7*a*-7*d* has a single vertical movement passage 22*e*; guide rod 202 of FIGS. 8*a*-8*d* has two vertical movement passages, 22*f* and 22*g*; and guide rod 203 of FIGS. 9*a*-9*d* has three vertical movement passages, 22*h*, 22*i* and 22*j*. It will be noted that the elevational sectional view of each of FIGS. 7*d*, 8*d*, 9*d* and 10*d* is taken as along the line B-B in the corresponding top plan view (FIG. 7*c*, 8*c*, 9*c* or 10*c*).

It is to be understood that the invention is not limited to the features and embodiments hereinabove specifically set forth, but may be carried out in other ways without departure from its spirit.

What is claimed is:

1. A capsule container for storing plural capsules and discharging the stored capsules individually, comprising:

(a) an upwardly open container body including a receptacle portion for holding a plurality of capsules;

(b) a cap mounted on the container body for manual rotation relative thereto about a vertical axis and having a discharge port;

(c) an upright discharge guide rod disposed within and fixedly secured to the receptacle portion and having at least one outwardly open vertical movement passage on its periphery; and (d) a hollow cylinder coupled to the cap for rotation therewith, extending downwardly from the cap through the receptacle portion in surrounding concentric relation to the guide rod, the cylinder having an inner surface bearing a screw thread facing the at least one vertical movement passage, a lower part of the cylinder having an entry port for admitting stored capsules from the receptacle portion individually into the cylinder, and the cylinder communicating upwardly with the discharge port, wherein the screw thread and the at least one vertical movement passage are mutually arranged to receive individual capsules admitted into the cylinder through the entry port, and, upon rotation of the cap in a particular direction relative to the container body, to cause admitted capsules to be raised one by one from the entry port to the discharge port.

2. A capsule container as defined in claim 1, wherein the container body includes a main body portion joined to a lower part of the receptacle portion.

3. A capsule container as defined in claim 1, wherein the guide rod has a plurality of outwardly open vertical movement passages on its periphery, the screw thread facing all of said vertical movement passages, and wherein the screw thread and each of the vertical movement passages are mutually arranged to receive individual capsules admitted into the cylinder through the entry port, and, upon rotation of the cap in a particular direction relative to the container body, to cause admitted capsules to be raised one by one from the entry port to the discharge port.

4. A capsule container as defined in claim 1, wherein the guide rod has an upper end exposed above the hollow cylinder.

5. A capsule container as defined in claim 1, wherein the hollow cylinder includes a capsule inflow guide protruding outwardly from the cylinder on one side of the entry port.

6. A capsule container as defined in claim 1, including a container lid, mountable over the cap.

7. A capsule container as defined in claim 1, including multiple first interlocking protrusions formed on the cap and multiple second interlocking protrusions formed on the cylinder for coupling with the first interlocking protrusions so that the cylinder rotates with the cap.

8. A capsule container as defined in claim 1, including a first ratchet gear provided on the container body and a second ratchet gear provided on the cap, wherein the first and second gears interlock to restrict rotation of the cap about the vertical axis to said particular direction.

9. A capsule container for storing plural capsules and discharging the stored capsules individually, comprising:

(a) a hollow, upwardly open vessel for holding a plurality of capsules;

(b) a cap mounted on the vessel for rotation relative thereto about a vertical axis, having a centrally disposed discharge cover provided with a discharge port;

(c) a discharge guide rod mounted within the vessel and extending along said vertical axis, said guide rod being coupled to the vessel so as to be fixed against rotation relative thereto and having an outer surface formed with a plurality of straight, outwardly opening vertical movement passages; and (d) a hollow cylinder concentrically surrounding said guide rod, coupled to the cap for rotation therewith about said vertical axis and communicating upwardly with the discharge port, said cylinder having an inner surface formed with a screw thread facing the plurality of vertical movement passages on a periphery of the guide rod, a lower part of the cylinder having an entry port for admitting stored capsules from the vessel individually into the cylinder, with a capsule inflow guide protruding outwardly from one side of the entry port and an upper cover protruding outwardly from the top of the entry port, wherein the screw thread and each of the vertical movement passages are mutually arranged to receive individual capsules admitted into the cylinder through the entry port and, upon rotation of the cap in a particular direction relative to the vessel, to raise admitted capsules one by one from said space to the discharge port.

10. A capsule container as defined in claim 9, wherein a main container body is coupled to the exterior of the vessel.

11. A capsule container as defined in claim 9, wherein the vessel has a bottom with an anti-friction part formed therein.

12. A capsule container as defined in claim 9, wherein a first sealing ring is formed on the inside of the vessel so as to be in close contact with an inner periphery of the vessel.

13. A capsule container as defined in claim 9, including a vessel lid removably mounted in a closed position on the vessel, the lid having a second sealing ring of elastic material formed on the inside of the vessel lid so as to be in close contact with a top surface of the cap when the vessel lid is in said closed position; and a sealing driver formed in close contact with the second sealing ring of the vessel lid on the top surface of the cap.

14. A capsule container as defined in claim 9, wherein the vertical movement passages are distributed substantially equidistantly around an outer periphery of the guide rod.

15. A capsule container as defined in claim 9, wherein a slope is formed on the lower side of the discharge port so that capsules can be naturally discharged from the discharge port.

16. A capsule container as defined in claim 9, wherein each of the vertical movement passages of the discharge guide rod has an inner surface formed in a curved shape.

17. A capsule container as defined in claim 9, wherein the number of vertical movement passages on the periphery of the discharge guide rod is between one and eight.

18. A capsule container as defined in claim 9, wherein an inflow slope part is formed at the bottom of each of the vertical movement passages.

19. A capsule container as defined in claim 9, wherein when the rotary cap is rotated one turn, capsules accommodated in the vessel are introduced into the vertical movement passages formed on the outer periphery of the discharge guide rod, and are sequentially moved and discharged upward by following the screw thread of the rotary cylinder.

* * * * *